US006938864B2

(12) United States Patent
Simonian et al.

(10) Patent No.: US 6,938,864 B2
(45) Date of Patent: Sep. 6, 2005

(54) BOARD STORAGE AND DISPLAY DEVICE

(75) Inventors: Michael Arthur Simonian, San Francisco, CA (US); Daniel W. Peter, Oakland, CA (US)

(73) Assignee: Astro Studios, San Francisco, CA (US)

( * ) Notice: Subject to any disclaimer, the term of this patent is extended or adjusted under 35 U.S.C. 154(b) by 209 days.

(21) Appl. No.: 10/397,673

(22) Filed: Mar. 25, 2003

(65) Prior Publication Data

US 2003/0178539 A1 Sep. 25, 2003

Related U.S. Application Data

(60) Provisional application No. 60/366,995, filed on Mar. 25, 2002.

(51) Int. Cl.[7] ..... F16M 11/00
(52) U.S. Cl. ..... 248/200
(58) Field of Search ..... 248/200, 303, 248/317, 339, 205.1, 309.1, 316.8, 207, 475.1, 235, 250; 224/87.01, 89.01, 94.02

(56) References Cited

U.S. PATENT DOCUMENTS 4,183,522 A * 1/1980 Killen ..... 473/483
4,634,010 A * 1/1987 Otema ..... 211/96
5,120,012 A * 6/1992 Rosenau ..... 248/201
5,141,116 A * 8/1992 Mojica ..... 211/60.1
5,201,896 A * 4/1993 Kruszewski ..... 248/278.1
5,305,897 A * 4/1994 Smith ..... 211/85.7
5,799,915 A * 9/1998 Morey ..... 248/201
5,833,079 A * 11/1998 Roberts ..... 211/85.7
6,045,100 A * 4/2000 Shields ..... 248/222.51
6,135,402 A * 10/2000 Hatano et al. ..... 248/207
6,196,397 B1 * 3/2001 Maher ..... 211/85.7
6,293,412 B1 * 9/2001 Draper ..... 211/4
6,467,745 B1 * 10/2002 Sickels ..... 248/242

* cited by examiner

*Primary Examiner*—Leslie A. Braun
*Assistant Examiner*—A. Joseph Wujciak
(74) *Attorney, Agent, or Firm*—Jones Day; Brett Lovejoy

(57) ABSTRACT

A display device configured to receive a board shaped sporting device. The display device has substantially parallel arms that extend away from a mounting surface thereby forming at least one slot. A board shaped sporting device, such as a skateboard, is received by the slot and thereafter cantilevered in a storage position. The display device leaves the design of the received board substantially unobstructed for display.

16 Claims, 7 Drawing Sheets

BOARD STORAGE AND DISPLAY DEVICE

This application claims priority to provisional application Ser. No. 60/366,995, filed Mar. 25, 2002, the entire disclosure of which is incorporated by reference herein.

TECHNICAL FIELD OF THE INVENTION

Generally the present invention relates to a display device. More particularly the present invention relates to a display device for displaying board shaped devices such as skateboards, snowboards, and wakeboards.

DESCRIPTION OF THE RELATED ART

For over forty years skateboarding has contributed to popular culture, counter culture, and youth culture. Over these years skateboarding has changed with the culture as well as do its part in forming modern culture. Skateboarding is often seen as the origin of many of today's 'boarding' sports such as snowboarding, wakeboarding, and the like. Throughout its evolution, the design of the skateboard has changed over time, however, it has generally remained the same. Typically, a skateboard is a short and narrow molded plywood board shaped object with a set of four wheels that is ridden on a smooth hard surface such as asphalt or concrete. Similarly, a snowboard is a short narrow molded board shaped object that is ridden on snow. A wakeboard is a short molded board shaped object that is ridden on water while being towed behind a motorboat.

These types of sporting objects share a similar board like shape. Additionally, these sporting devices have evolved as a display medium for the artwork of the particular culture. Skateboards have traditionally incorporated a silk-screened design on the underside of the skateboard that represents a certain model or feature of the current culture. Each skateboard design is a limited edition silk-screen artwork. A look back at the silk-screened designs on skateboards over the decades is a chronicled timeline through the history of skateboarding. Similarly, wakeboarding and snowboarding uses the 'boards' as a medium of expression for artwork that expresses a time of that culture.

A drawback of current storage devices is that they do not provide for the display of the artwork and cultural story associated with these boarding sports devices. A further drawback is that the current storage devices do not provide a variety of possible display orientations.

SUMMARY OF THE INVENTION

The present invention discloses a display device that comprises a bracket configured and dimensioned to be coupled to a mounting surface. The bracket defines a receiving slot comprising at least two substantially parallel arms extending substantially linearly away from the mounting surface. The substantially parallel arms extend at an angle upward from the horizontal and have a width of at least 2.5 centimeters. The substantially parallel arms have a length of at least 2.5 centimeters and the receiving slot is configured and dimensioned to receive a board shaped sporting device.

In another embodiment, the receiving slot of the display device forms an angle between 10–70 degrees from the horizontal. In alternate embodiments, the display device tapers from between 2.5 centimeters in width at a surface configured to couple to a mounting surface to at least 5 centimeters in width at a surface configured to receive the board shaped sporting device.

The display device of the present invention is preferably configured to display a skateboard, a snowboard, or a wakeboard.

It is preferred that the display device of the present invention be constructed from a metal, a plastic, or wood.

In use, the display device of the present invention is configured to receive between 5–40 percent of the width of the board shaped sporting device. In another embodiment of the present invention the display device is configured to receive between 10–25 percent of the width of the board shaped sporting device.

BRIEF DESCRIPTION OF THE FIGURES

For a better understanding of the nature and objects of the present invention reference should be made to the following detailed description taken in conjunction with the accompanying drawings, in which.

DETAILED DESCRIPTION OF THE INVENTION

The present invention utilizes an economically efficient design to create a hook for holding a board shaped sporting device. In FIGS. 1–7 the hook 100 of the present invention is semi-symmetrical with slots 125 for holding an object. It should be appreciated by one skilled in the art that the hook can be constructed from any appropriate material. By way of example but not limitation, the hook can be made from aluminum, steel, tin, plastic, wood, laminated wood, or the like. Preferably, the hook of the present invention is constructed from aluminum. More preferably, the hook of the present invention is constructed from extruded aluminum.

Figure 1:
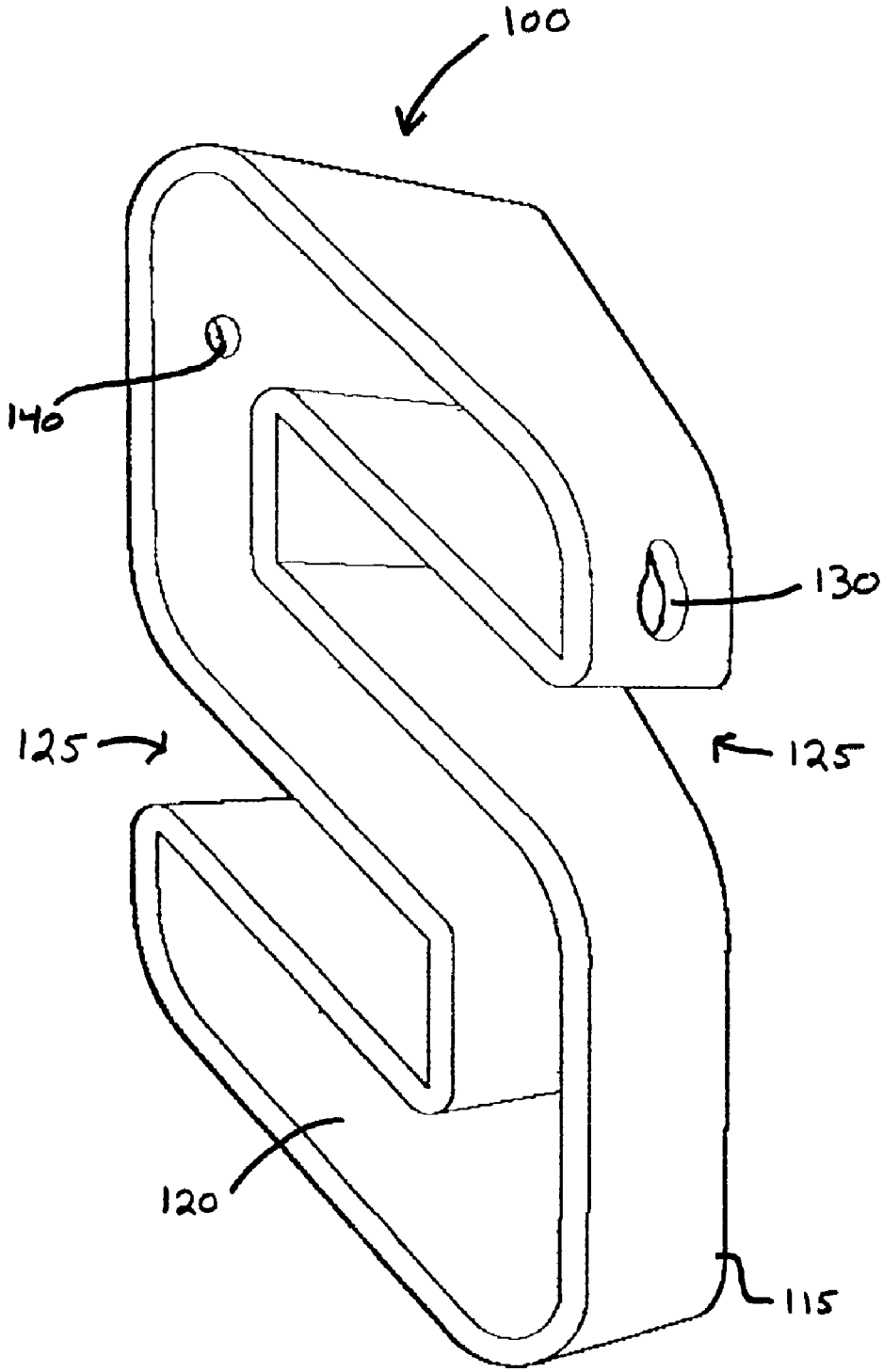
FIG. 1 is a perspective view of an embodiment of the present invention.
Figure 2:
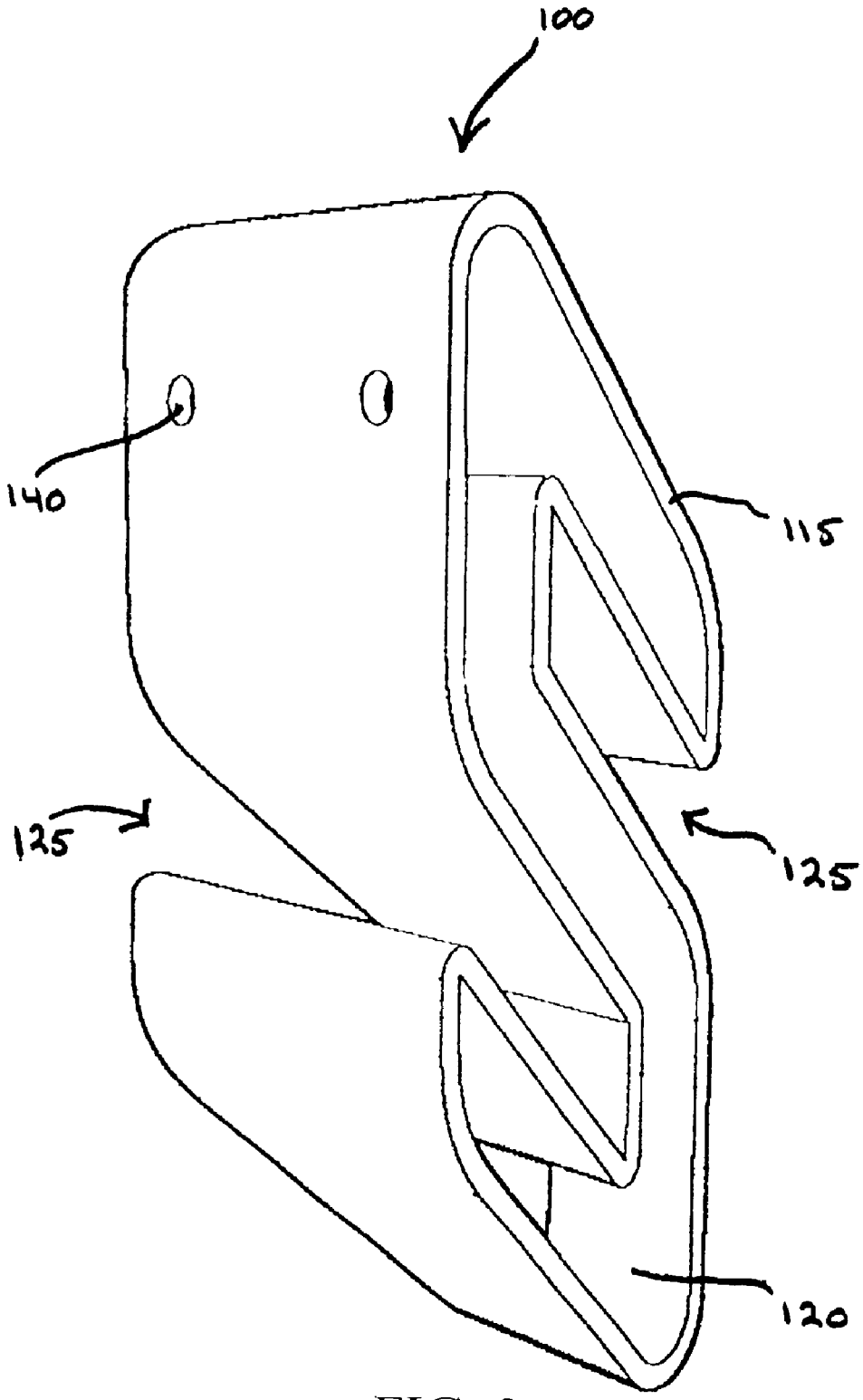
FIG. 2 is a perspective view of another embodiment of the present invention.
Figure 3:
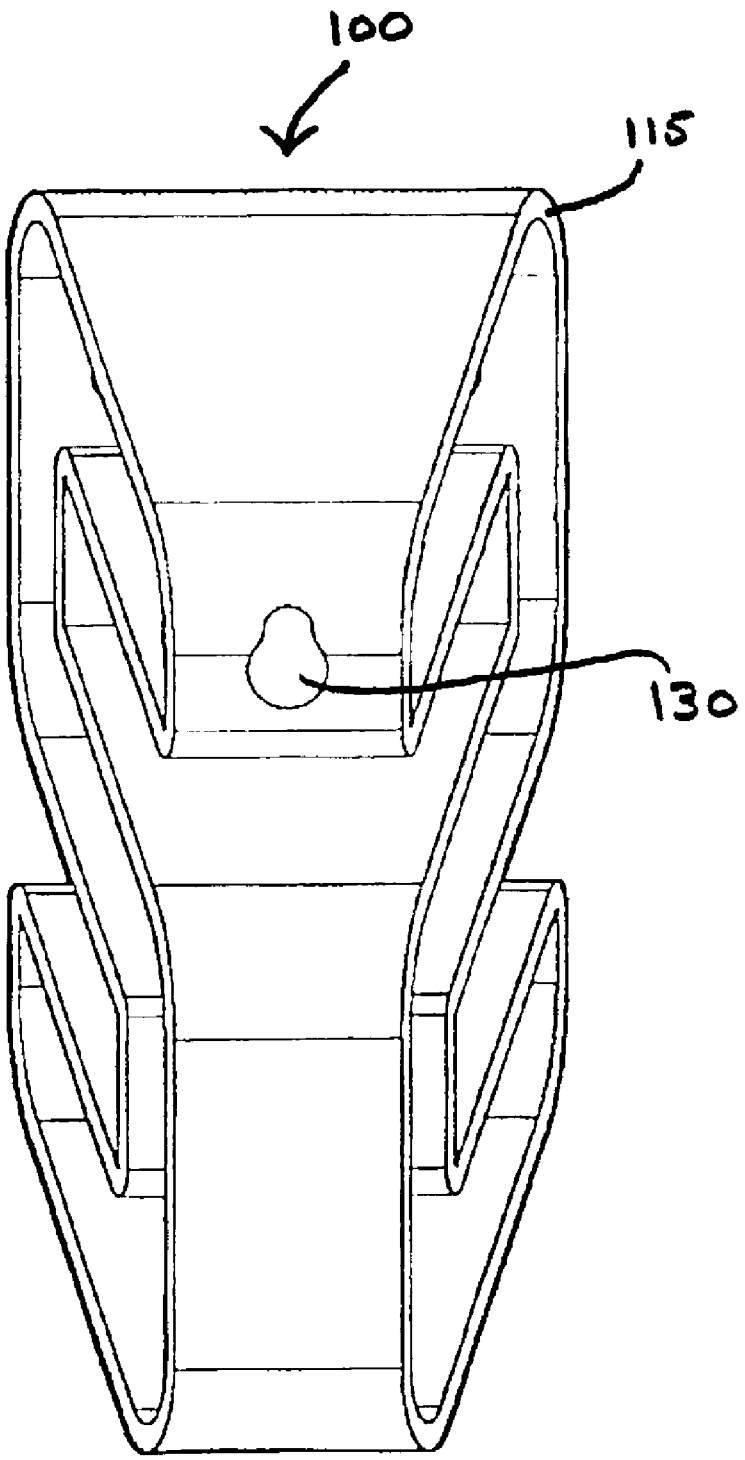
FIG. 3 if a rear view of an embodiment of the present invention.
Figure 4:
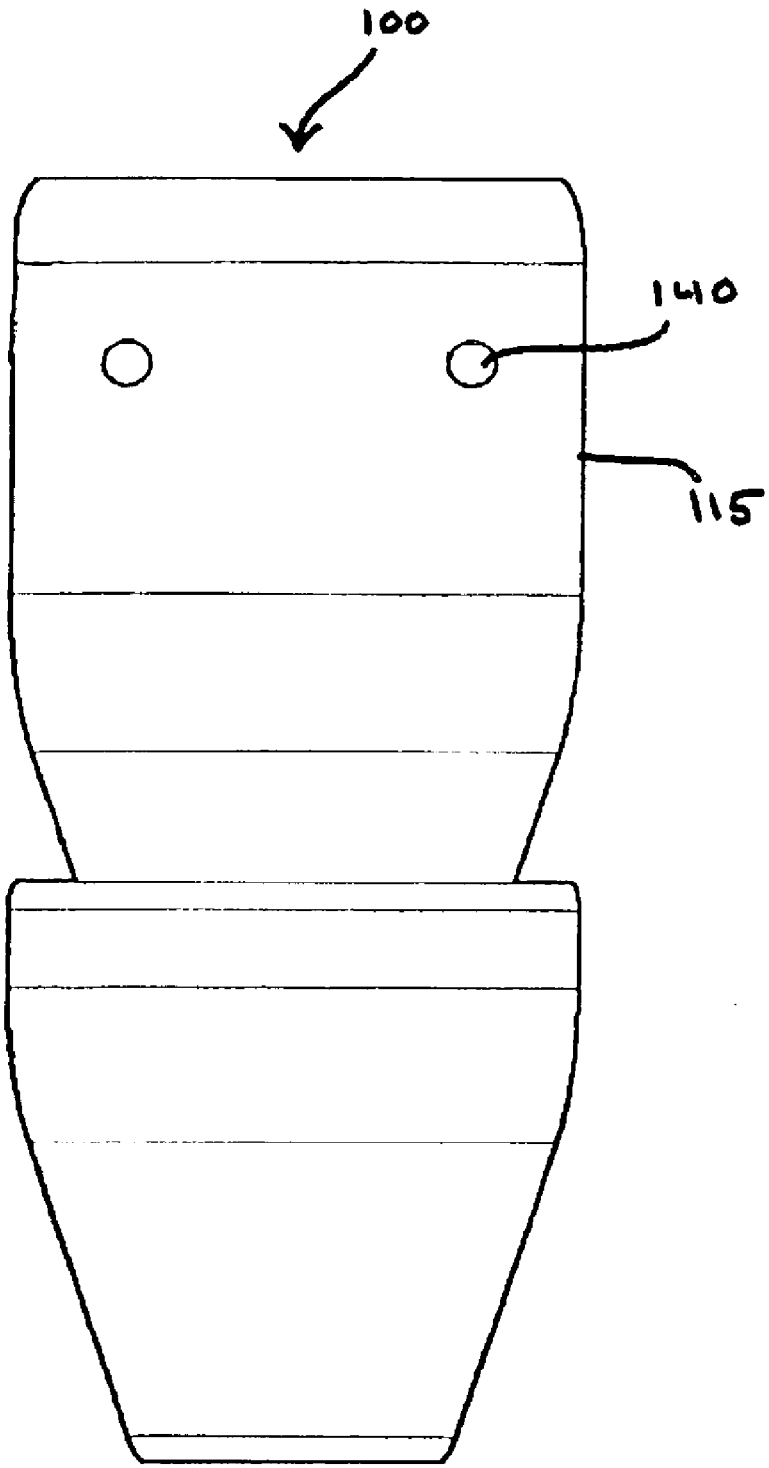
FIG. 4 is a front view of an embodiment of the present invention.
Figure 5:
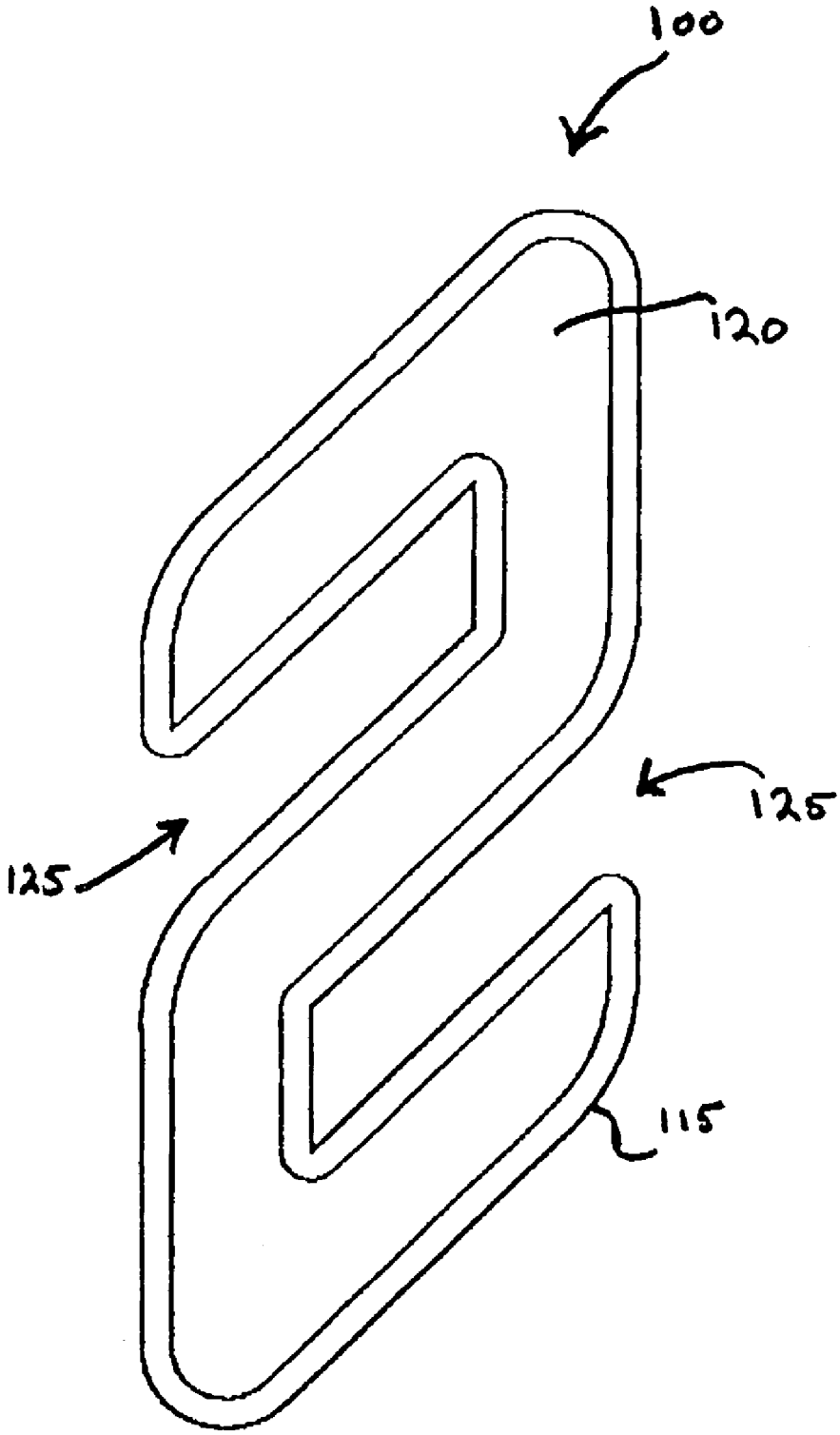
FIG. 5 is a side view of an embodiment of the present invention.

In a preferred embodiment the hook 100 of the present invention is made out of one piece of material forming the frame 115, which is generally shaped in an S shape. As shown in FIGS. 1–3 the frame 115 defines an inner space 120 that is preferably free from material such that the hook 100 is lightweight. Within the S configuration, the frame 115 of the hook 100 defines two slots 125. Generally, the frame 115 of the slots 125 is flat or planar and substantially parallel to the frame 115 on the opposing side of the slot 125. The slots 125 are angled in such a way that at least one slot 125 extends upward, away from the horizontal. Because the slot 125 extends angled upward away from the horizontal, a board shaped object inserted therein becomes cantilevered, see FIG. 7. The weight of the board extending away from the slot 125 causes the edge of the board that is inserted into the slot 125 to tilt upward and embrace the upper portion of the frame 115 of the slot 125.

In a preferred embodiment the slots 125 are sized to receive the board portion of a skateboard. In use, the board portion of a skateboard is inserted into a slot 125, and the board becomes cantilevered into position. In another embodiment slots 125 are sized to receive a snowboard. In yet another embodiment slots 125 are sized to receive a wakeboard.

In an embodiment of the invention the frame 115 is narrower on one side of the hook 100 than the other. As seen in FIG. 3, the frame 115 tapers from one side to the other. The width of the frame 115 is selected to provided stability to the particular object to be received by the slots 125 of the hook 100. Preferably, the frame is about 2.5 centimeters (cm) in width on one side and about 7 cm in width on the other side. In another embodiment, the frame 115 is about 2.5 cm in width on one side and about 12 cm wide on the other side. In use, the board shaped device received by the slot 125 is held stably in position when the frame 115 is wider.

It is preferred that the hook 100 be adapted to hang on a wall or similar structure by a mounting hole 130. The mounting hole 130 is preferably a hole with a larger portion and a smaller portion. This provides for easy installation of the hook 100 on a wall or other surface to which it is to be attached. In use, a fastening device that has a head larger than its shaft, such as a screw for example, can be placed partially into a wall or other surface to which the hook 100 is to be attached. The larger portion of the mounting hole 130 can then be placed over the screw head, for example, and then the hook 100 can be adjusted such that the smaller portion of the mounting hole 130 receives the shaft of the screw. Similarly, because the hook 100 is semi-symmetric and can be used in a reversible manner, the mounting hole 130 can be used to mount an object for display to the hook 100.

Figure 6:
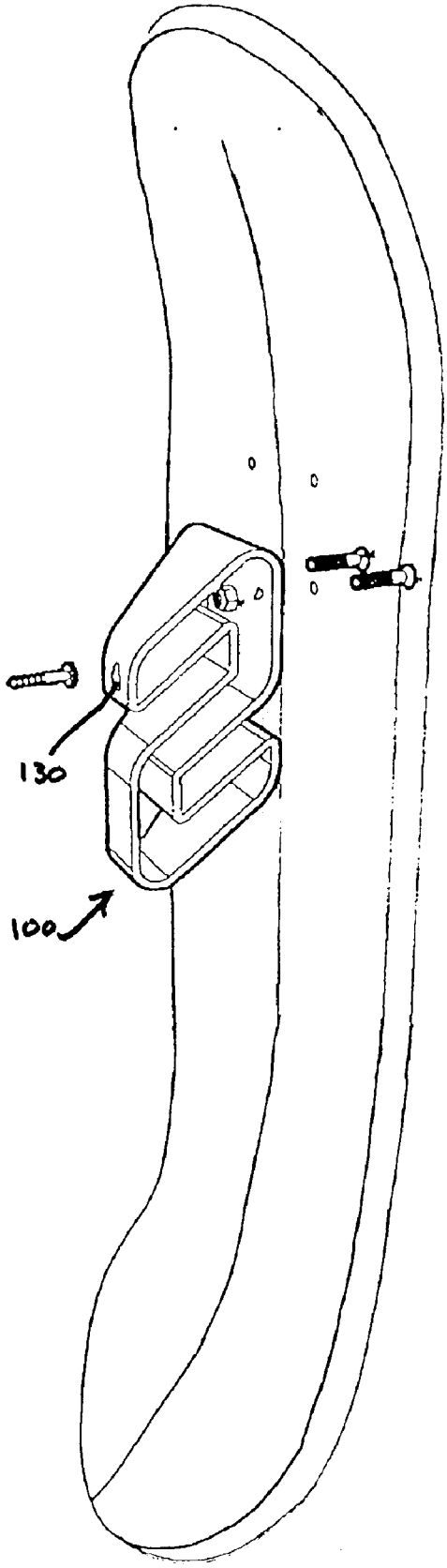
FIG. 6 is a perspective view of an embodiment of the present invention configured to vertically hold a boarding device.
Figure 7:
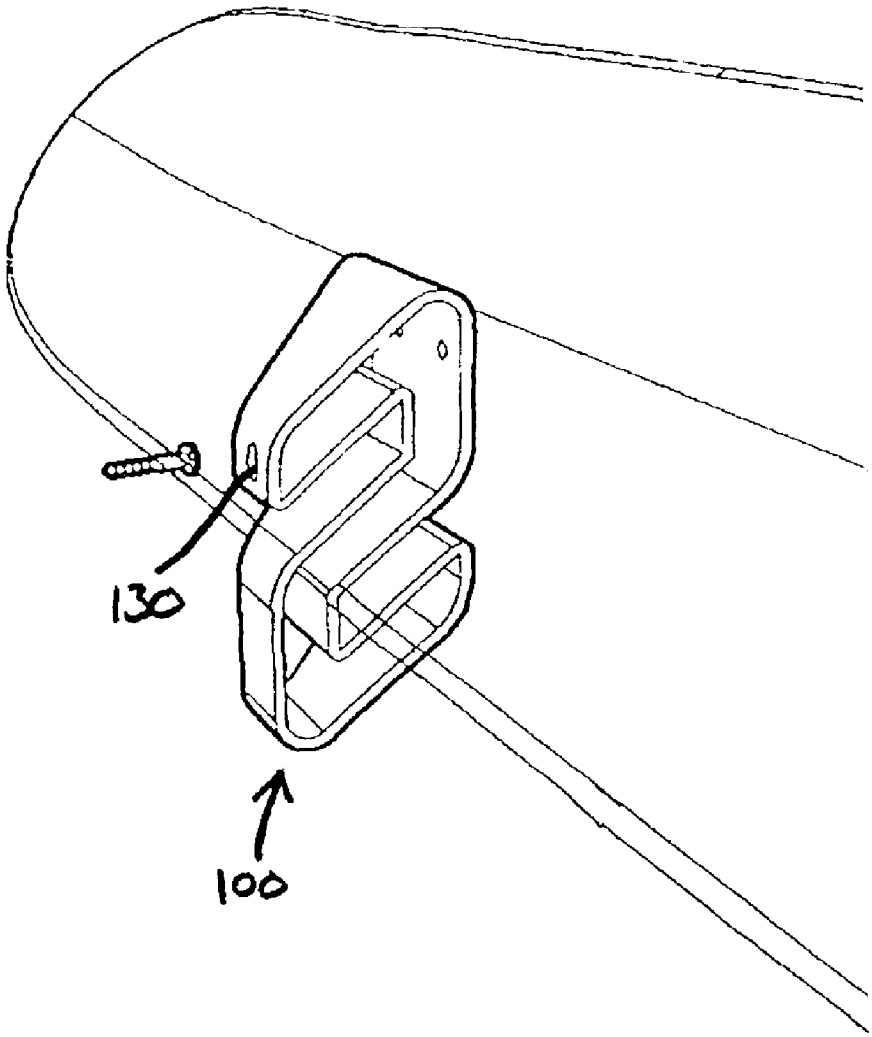
FIG. 7 is a perspective view of an embodiment of the present invention configured to cantilever restrain a boarding device.

In a preferred embodiment the hook 100 has at least two holes 140 through the frame 115 on one mounting surface of the hook 100. Holes 140 can be used to mount an object for display, as shown in FIG. 6. In an alternative embodiment, holes 140 can be used to attach the hook 100 to a mounting surface. Preferably the holes 140 are sized and spaced to receive a skateboard by attaching through the wheel assembly mounting holes in the skateboard. In an alternate embodiment, holes 140 are sized and spaced to receive a snowboard by mating with the holes on a snowboard for attachment of the boot and binding assembly.

In use, when a board shaped sports device, such as, for example, a skateboard, snowboard, wakeboard, or the like is inserted into the slot 125 the artwork on the board is substantially unobstructed. Therefore, the artwork and the cultural story told thereby can be viewed and displayed. Furthermore, the hook 100 is relatively small, lightweight, and readily adaptable. Therefore, the hook 100 and the boards it is configured to receive can be displayed virtually anywhere. For example, boards can be displayed on the walls of a store, in the hallway of a store, or the like.

Many modifications and variations of this invention can be made without departing from its spirit and scope, as will be appreciated by those skilled in the art. The specific embodiments described herein are offered by way of example only. The embodiments were chosen and described in order to best explain the principles of the invention and its practiced applications, to thereby enable others skilled in the art to best utilize the invention and various embodiments with various modifications as are suited to the particular use contemplated. The invention is to be limited only by the terms of the appended claims, along with the full scope of equivalents to which such claims are entitled

What is claimed is:

1. A display device, comprising:

an S-Shaped bracket configured and dimensioned to be coupled to a mounting surface; and a board shaped sporting device;

wherein said bracket defines a receiving slot comprising:

at least two substantially parallel arms adapted to extend substantially linearly away from the mounting surface;

wherein said at least two substantially parallel arms each extend upwardly from a the horizontal plane normal to said mounting surface;

wherein said at least two substantially parallel arms have a width of at least 2.5 centimeters;

wherein said substantially parallel arms have a length of at least 2.5 centimeters;

wherein a receiving enclave is formed by an upper substantially parallel arm and a lower substantially parallel arm in said at least two substantially parallel arms, the receiving enclave dimensioned and configured to receive said board shaped sporting device between said upper substantially parallel arm and said lower substantially parallel arm such that said board shaped sporting device rests in said receiving enclave in such a manner that a longitudinal axis of said board is substantially parallel to said horizontal plane; and wherein said board shaped sporting device is a skateboard, a snowboard, or a wakeboard.

2. The display device of claim 1, wherein an angle defined by (i) a substantially parallel arm in said at least two substantially parallel arms and (ii) said horizontal plane normal to said mounting surface is between 10 degrees and 70 degrees.

3. The display device of claim 1, wherein said bracket tapers from between 2.5 centimeters in width at a surface configured to couple to the mounting surface to at least 5 centimeters in width at a surface configured to receive the board shaped sporting device.

4. The display device of claim 1, wherein said bracket is constructed from a material selected from the group consisting of iron, steel, stainless steel, copper, a copper alloy, brass, aluminum, magnesium, a magnesium alloy, titanium, a titanium alloy, tin, a ceramic, a plastic, polyethylene, polypropylene, cellulose acetate, rigid vinyl, nylon, polymethyl methacrylate, polystyrene, acrylonitrile butadiene-styrene, melamine-formaldehyde, polyester woven cloth-reinforced, wood, laminated wood, and plywood.

5. The display device of claim 1, wherein said bracket defines at least two holes configured and dimensioned to couple with at least two holes in said board shaped sports device.

6. The display device of claim 1, wherein said receiving enclave receives between 5 percent and 40 percent of the width of the board shaped sporting device.

7. The display device of claim 1, wherein said receiving enclave receives between 10 percent and 25 percent of the width of the board shaped sporting device.

8. A display device, comprising:

a board shaped sporting device; and a reversible S-Shaped bracket configured and dimensioned to receive said board shaped sporting device;

wherein said reversible bracket has at least one mounting surface defining a substantially planar surface;

wherein said reversible bracket defines at least two receiving slots, each of said at least two receiving slots configured and dimensioned to receive the board shaped sporting device;

wherein each of said at least two receiving slots are adapted to extend substantially linearly;

wherein each of said at least two receiving slots extend at an angle that is between 5 degrees and 70 degrees from a mounting surface of the reversible bracket; and wherein a receiving slot in said at least two receiving slots comprises an upper substantially parallel arm and a lower substantially parallel arm such that, when said board shaped sporting device is received by said receiving slot, the board shaped sporting device is (i) cantilevered between said upper substantially parallel arm and said lower substantially parallel arm and (ii) rests on said lower substantially parallel arm, and wherein the board shaped sporting device is a skateboard, a snowboard, or a wakeboard.

9. The display device of claim 8, wherein a width of said bracket tapers from between 2.5 centimeters from one mounting surface to a width of at least 5 centimeters at the other mounting surface.

10. The display device of claim 8, wherein said bracket is constructed from a material selected from the group consisting of metal, plastic, and wood.

11. The display device of claim 8, wherein a receiving slot in said at least two receiving slots receives between 5 percent and 40 percent of the width of the board shaped sporting device.

12. The display device of claim 8, wherein a receiving slot in said at least two receiving slots receives between 10 and 25 percent of the width of the board shaped sporting device.

13. A display device, comprising:

a board shaped sporting device; and an S-Shaped bracket configured and dimensioned to couple to a mounting surface;

wherein said bracket tapers from a width of at least 2.5 centimeters at a first surface that is configured and dimensioned to couple to a mounting surface, to a width of at least 5 centimeters at a second surface that is configured to receive said board shaped sporting device;

wherein said bracket defines a receiving slot comprising:

at least two substantially parallel arms extending substantially linearly away from the first surface;

wherein said substantially parallel arms are adapted to extend at an angle of between 30 degrees and 60 degrees upward from a horizontal plane normal to said first surface;

wherein said substantially parallel arms have a width of at least 2.5 centimeters;

wherein said substantially parallel arms have a length of at least 2.5 centimeters; and wherein a receiving enclave is formed by an upper substantially parallel arm and a lower substantially parallel arm in said at least two substantially parallel arms, the receiving enclave dimensioned and configured to receive a board shaped sporting device between said upper substantially parallel arm and said lower substantially parallel arm such that said board shaped sporting device rests in said receiving enclave in such a manner that a longitudinal axis of said board is substantially parallel to said horizontal plane, and wherein said shaped sporting device is a skateboard, a snowboard, or a wakeboard.

14. The display device of claim 13, wherein said bracket is constructed from a material selected from the group consisting of iron, steel, stainless steel, copper, a copper alloy, brass, aluminum, magnesium, a magnesium alloy, titanium, a titanium alloy, tin, a ceramic, a plastic, polyethylene, polypropylene, cellulose acetate, rigid vinyl, nylon, polymethyl methacrylate, polystyrene, acrylonitrile butadiene-styrene, melamine-formaldehyde, polyester wovencloth-reinforced, wood, laminated wood, and plywood.

15. The display device of claim 13, wherein said enclave receives between 5 percent and 40 percent of the width of the board shaped sporting device.

16. The display device of claim 13, wherein said enclave receives between 10 percent and 25 percent of the width of the board shaped sporting device.

* * * * *